US012546069B2

(12) United States Patent
Jewski

(10) Patent No.: US 12,546,069 B2
(45) Date of Patent: Feb. 10, 2026

(54) SHUTOFF APPARATUS AND SYSTEM

(71) Applicant: Joachim Jewski, Euskirchen (DE)

(72) Inventor: Joachim Jewski, Euskirchen (DE)

( * ) Notice: Subject to any disclaimer, the term of this patent is extended or adjusted under 35 U.S.C. 154(b) by 704 days.

(21) Appl. No.: 18/071,073

(22) Filed: Nov. 29, 2022

(65) Prior Publication Data

US 2023/0089264 A1 Mar. 23, 2023

Related U.S. Application Data

(63) Continuation of application No. PCT/DE2021/000100, filed on May 27, 2021.

(30) Foreign Application Priority Data

May 30, 2020 (DE) ..... 102020003293.1

(51) Int. Cl.
*E01F 13/02* (2006.01)

(52) U.S. Cl.
CPC ..... *E01F 13/026* (2013.01)

(58) Field of Classification Search
CPC ..... E01F 13/02
USPC ..... 404/6, 9, 11
See application file for complete search history.

(56) References Cited

U.S. PATENT DOCUMENTS 3,564,769 A * 2/1971 Wilson et al. ..... E01F 13/046 49/35
3,660,935 A * 5/1972 Boots ..... E01F 13/046 49/35
4,003,161 A * 1/1977 Collins ..... E01F 13/046 49/35
5,192,159 A * 3/1993 Higginson ..... E01F 13/046 404/11
5,462,384 A * 10/1995 Arlandis ..... E03B 9/20 404/6
5,481,828 A * 1/1996 Kentrotas ..... E01F 13/046 49/35

(Continued)

FOREIGN PATENT DOCUMENTS

CH 597433 4/1978
DE 6930949 2/1970

(Continued)

OTHER PUBLICATIONS

International Search Report issued in corresponding International Application PCT/DE2021/000100, mailed Aug. 31, 2021.

*Primary Examiner* — Raymond W Addie
(74) *Attorney, Agent, or Firm* — Burris Law, PLLC

(57) ABSTRACT

The present disclosure relates to a barrier apparatus for arrangement on a subsurface. The barrier apparatus includes an at least substantially tubular hollow part that defines a longitudinal direction of the barrier apparatus, an actuating element that is arranged at a first free end of the hollow part and is movable relative to the hollow part between a loose position and an anchored position, a mechanical anchoring mechanism that is arranged opposite the actuating element in relation to the longitudinal direction and includes a movable bolt element, a movably mounted actuating rod that is fixed to the actuating element, extends in the longitudinal direction, is arranged in the hollow part and is mechanically coupled to the anchoring mechanism, and a barrier system.

29 Claims, 3 Drawing Sheets

(56) References Cited

U.S. PATENT DOCUMENTS

| | | | | |
|---|---|---|---|---|
| 5,520,479 | A * | 5/1996 | Hernandez | E01F 13/026 49/35 |
| 6,409,419 | B1 * | 6/2002 | Hernandez | E01F 13/04 404/6 |
| 7,452,158 | B1 * | 11/2008 | Siu | E01F 13/046 404/11 |
| 11,060,254 | B2 * | 7/2021 | Kirn | E01F 13/026 |

FOREIGN PATENT DOCUMENTS

| | | | | |
|---|---|---|---|---|
| FR | 2639052 | A1 * | 5/1990 | E01F 13/046 |
| FR | 3029544 | | 6/2016 | |
| GB | 2269616 | | 2/1994 | |
| JP | 2017082449 | | 5/2017 | |

* cited by examiner

SHUTOFF APPARATUS AND SYSTEM

CROSS-REFERENCE TO RELATED APPLICATIONS

The present application is a continuation of International Application No. PCT/DE2021/000100, filed on May 27, 2021, which claims priority to and the benefit of Germany Patent Application No. DE 102020003293.1, filed on May 30, 2020. The disclosures of the above applications are incorporated herein by reference.

FIELD

The present disclosure relates to a barrier device and a barrier system having the barrier device, and, in particular a barrier device that is to be arranged on a base surface.

BACKGROUND

The statements in this section merely provide background information related to the present disclosure and may not constitute prior art.

Many different embodiments of barrier devices of the initially mentioned type are part of the state-of-the-art. They function for temporarily or permanently blocking off a section of the base surface, i.e., to protect it from access or travel, for the most part a traffic area. One or more barrier devices are arranged for this purpose at an edge of the section on the base surface to be protected.

Many barrier devices comprise an anchoring mechanism that functions for optionally anchoring the barrier device to the base surface. As a result of the anchoring, the barrier device can be neither moved on the base surface nor be removed from the base surface.

Swiss Publication No. CH 597433A5, for example, discloses a barrier device configured as a traffic cone, comprising an anchoring mechanism for anchoring the traffic cone on the base surface and an actuation element for actuating the anchoring mechanism, which is arranged on the tip of the traffic cone.

If persons and autonomous driving industrial trucks, for example, forklifts, move jointly over the base surface, for example, a floor of a warehouse or manufacturing facility, there is an increased risk of injury for the persons. Health and safety regulations are met in that a section of the base surface within which the person is moving is not traveled by an industrial truck, so that the person and the industrial truck move or remain within spatially separated sections of the base surface.

Modern industrial trucks are configured for detecting, recognizing, and avoiding specific barrier devices by means of a camera or sensors, for example, by means of ultrasound or electromagnetic radiation, i.e. they stop in front of them or they follow another trajectory. Therefore, it is customary to block a section of the base surface over which a person to be protected will move by arranging barrier devices along the edge of the section and anchoring the barrier devices arranged there on the base surface, and consequently protecting the section from being driven on by industrial trucks.

If anchored barrier devices are unknowingly or carelessly released, relocated, or removed by other persons unbeknownst to the person to be protected, the risk of injury for the person to be protected is increased.

The present disclosure addresses these and other issues related to a barrier device.

SUMMARY

This section provides a general summary of the disclosure and is not a comprehensive disclosure of its full scope or all of its features.

In one form, the present disclosure is directed to a barrier device to be arranged on a base surface, and including an at least essentially tubular hollow body that defines a longitudinal direction of the barrier device, an actuation element that is arranged in a first free end of the hollow body and can be moved relative to the hollow body between a release position and an anchoring position, a mechanical anchoring mechanism that is arranged opposite to the actuation element with reference to the longitudinal direction and comprises a movable locking element, and an actuator rod that is fixed on the actuation element that extends in longitudinal direction and is movably mounted, which is arranged in the hollow body and is mechanically coupled to the anchoring mechanism. The barrier device can be anchored to the floor with the aid of the anchoring mechanism so as to block off a section of the base surface temporarily or permanently e.g., in order to protect it from access or travel. The barrier device is therefore an important means of occupational safety, in one form if persons and autonomously driving industrial trucks move jointly over the base surface, in one form, a floor of a warehouse or manufacturing facility.

According to the present disclosure, the barrier device comprises a locking plate that is fixed relative to the tubular hollow body, and an actuation plate as an actuation element, wherein the actuation plate extends parallel to the locking plate in the release position, the anchoring position, and in each position between the release position and the anchoring position, and the locking plate and the actuation plate each have at least one hole, which together form a hole pair, and the at least one hole pair is aligned exclusively in the anchoring position.

The at least one aligned hole pair can be engaged by a padlock of a person to be protected and allows the barrier device to be locked if the actuation plate is in the anchoring position and the barrier device is anchored to the base surface. Accordingly, the anchoring of the locked barrier device can only be released by the person to be protected. To do this, the person opens the padlock and removes the passage of the padlock through the at least one aligned hole pair, whereupon the actuation plate moves into the release position, and the anchoring of the barrier device is released. In this way, the handling of the barrier device is easy, the safety of the barrier device is increased, and occupational safety is improved because of the increased safety of the barrier device.

In one form, the barrier device comprises a locking tube that extends in longitudinal direction and is fixed on the locking plate, which is arranged on the hollow body, fixed relative to the hollow body, and in one form partially projects from the hollow body. The locking tube has the function of fixing the locking plate. If the locking tube projects from the hollow body (e.g., beyond the first free end of the hollow body), this can be easily achieved without bending, whereby the handling of the barrier device is facilitated.

In many variations, the hollow body has a cone jacket-shaped peripheral wall or a cylinder jacket-shaped peripheral wall. A commercially available traffic cone or pylon can function as a hollow body with a cone jacket-shaped peripheral wall. In this case, the actuation device is arranged on the tip of the traffic cone.

A barrier post can be used as a barrier device with a cylinder jacket-shaped peripheral wall. However, hollow bodies whose cross section, taken transversely to the longitudinal direction, has a contour that differs from the circular shape, in one form a polygonal contour, are also included within the scope of the present disclosure.

A length of the hollow body measured in the longitudinal direction can be within a range of 100 mm to 1100 mm, and in one form, 300 mm, 500 mm, 700 mm, or 900 mm. Commercially available traffic cones are available in the mentioned lengths.

The locking plate and the actuation plate are cleverly provided with a plurality or multiple holes, in one form four holes each, forming a corresponding number of hole pairs, in one form four hole pairs. In this way, the barrier device can be locked by means of aligned hole pairs engaged by several padlocks. For a rotational movement of the actuation plate, the hole pairs are arranged at intervals from each other in a radial direction with reference to the rotational axis. For a translatory movement of the actuation plate, the hole pairs are arranged at a distance from one another perpendicular to the direction of the translation. The hole pairs are therefore arranged in the locking plate and the actuation plate in such a way that it is impossible for the holes of different hole pairs to align.

In an advantageous variation, the locking plate and the actuation plate have an at least essentially circular outer contour and/or extend perpendicular to the longitudinal direction. In other words, the locking plate and the actuation plate are configured in a disc shape. Owing to its direction of extension, a risk of injury, e.g., the risk of impalement or cuts is reduced in case a person should fall on the barrier device arranged on the base surface.

The actuation plate can ideally be rotated relative to the locking plate around an actuation angle which is within the range of 120° and 180° and is 150°, in one form. The actuation angle is an obtuse angle and provides a sufficient pivot angle for the locking element. In this variation, the actuation plate locks, in one form fully or at least partially, each hole of the locking plate in each relative position of the actuation plate to the locking plate which is different from the anchoring position. As a result, a padlock can be installed on the actuation plate or the locking plate exclusively in the anchoring position of the actuation plate or at least in a position close to the anchoring position of the actuation plate. In this way, it is provided that a position of the actuation plate that is different from the anchoring position is not mistaken for the anchoring position because of a padlock by the person to be protected due to a padlock, whereby the safety of the barrier device is further increased. In other variations of the barrier device, the actuation plate can be moved by an actuation distance relative to the locking plate.

Ideally, the at least one hole of the actuation plate and the at least one hole of the locking plate are configured as a borehole and each have a cylindrical shape with a cylindrical axis extending parallel to the longitudinal direction. With a rotational movement of the actuation plate relative to the locking plate, the cylindrical axis extends perpendicular to the direction of movement of the at least one hole. As a result, a rotation of the actuation plate is at least fundamentally precluded if a padlock engages through the aligned hole pair. This offers a considerable increase in safety in contrast to alternative implementations in which the cylindrical axis of a hole extends in the direction of movement of the hole, in one form, tangential to the circumference.

The locking plate and the actuation plate can in one form comprise mutually corresponding stop mechanism or a stop means, which define the actuation angle and the anchoring position and the release position and are arranged on mutually facing main faces of the locking plate and the actuation plate. The stop mechanism each provide two stop surfaces and inhibit a relative movement of the actuation plate and the locking plate beyond the actuation angle in a mechanically blocking manner. Two stop surfaces of the stop mechanism abut against each other in the anchoring position as well as also in the release position.

The barrier device practically comprises a handle, which is fixed on the actuation plate and/or projects from the actuation plate and/or has an at least essentially a U-shaped configuration. The handle facilitates carrying of the barrier device so that the barrier device is easy to handle.

In some variations, the locking plate has two recesses and the actuation plate has a locking bolt which reaches through the actuation plate, is mounted on the actuation plate so that that it can be displaced perpendicularly to the actuation plate and is pretensioned in direction of the locking plate, which, in the loose position, has a first recess, and in the anchoring position, has a second recess and is engaged. When the locking bolt is engaged, the actuation plate cannot leave the loose position or the anchoring position unintentionally, e.g., through inadvertent actuation, which increases the safety of the barrier device.

In a variation, the actuation rod is configured as an actuation shaft and the anchoring mechanism comprises a rotatably mounted anchoring shaft extending at an obtuse angle or perpendicularly to the actuation shaft and a coupling device, which is configured for transmitting the torque between the actuation shaft and the anchoring shaft. In this way, the locking element is capable of performing a pivoting motion whose pivot plane is not parallel to the surface of the base surface, e.g., it intersects the surface of the base surface.

In such variations, the coupling device can be configured as an angular gear or can comprise a universal joint. Angular gears comprise at least two bevel gears, e.g., bevel gear-shaped gear wheels. In order to realize a transmission angle of 90°, the coupling device can comprise two universal joints and be configured as a cardan joint. As an alternative, the coupling device can also be configured as a flexible shaft which is bent to reach the desired transmission angle, in one form, 90°.

The barrier device advantageously comprises a base plate, which is arranged opposite to the locking plate and is, in one form. mounted on the second free end of the hollow body, detachably or permanently. The base plate creates a distance between the hollow body and the base surface if the barrier device is arranged on the base surface. The anchoring mechanism can be arranged in the space gained as a result of the created distance. The base plate also protects the second free end of the hollow body form wear and tear as a result of a displacement over the base surface.

In one variation, the base plate is detachably fixed on the hollow body, in one form by means of several screws, in one form by means of four screws. Owing to the detachable fixation, the base plate can be easily exchanged in case of a defect, for example, a breakage, or wear and tear. The four screws can be evenly distributed in a circumferential direction of the hollow body, in one form, at four corners of a bottom section of the hollow body molded on the free end to provide a secure attachment of the base plate on the hollow body.

The base plate advantageously comprises plastic or metal or is made of plastic or metal and/or the thickness of the base plate measured perpendicularly to the main surfaces of the base plate is within a range of 15 mm to 35 mm and in one form, is 20 mm. The plastic can be selected from among polyamide, PVC, and the like. The metal can be configured as a sheet. The thickness of the base plate can be selected according to a space requirement of the anchoring mechanism. The base plate protects the hollow body from wear and tear as a result of a displacement over the base surface.

In advantageous variations, the anchoring shaft is rotatably mounted on the base plate. The anchoring shaft can be engaged through a borehole provided in the base plate. Bearing elements, e.g., sliding bearings for the anchoring shaft can be fixed in the bore.

In one form, the locking element has a hook-shaped configuration and is fixed on the anchoring shaft. The hook shape allows for the locking element to engage under a crosspiece of a bottom insert, which extends transversely to the pivot plane of the locking element. Owing to the fixation, e.g., in one form a rotationally fixed connection, the locking element is pivoted by rotating the anchoring shaft. A hook-shaped locking element can be cost-effectively produced and is easy to handle.

The locking element is ideally arranged on an outer side of the hollow body. Owing to the external arrangement, the locking element can be seen from outside. It can be visually directly determined if the locking element engages or not behind the crosspiece, and thus if the barrier device is anchored or not to the base surface. It is further noted that the locking element projects in a longitudinal direction from an outer surface of the base plate if the actuation element is in the anchoring position. As a result of the external arrangement of the locking element, the barrier device is crooked, e.g., its longitudinal direction is inclined with respect to the longitudinal direction of a barrier device anchored as intended if the barrier device is arranged on the base surface without being anchored. In this way, an incorrect operation of the barrier device is easily visually detectable, which is accompanied with an increased safety of the barrier device.

In some variations, the barrier device comprises a first mounting plate to hold the locking tube, which is fixed on the base plate and which is in one form detachably connected to the base plate, in one form screwed to the base plate. The first mounting plate positions the locking tube and can provide the fixation of the locking plate relative to the hollow body by means of the locking tube and the base plate.

The barrier device can also comprise a second mounting plate, which is fixed on the base plate, in one form detachably connected to the base plate, in one form screwed to the base plate for holding the locking tube with a passageway for mounting the actuation rod. The second mounting plate positions the locking tube and can provide the fixation of the locking plate relative to the hollow body by means of the locking tube and the base plate. The second mounting plate also functions as a support for the actuation rod.

In one form, the locking plate has a central passageway and the actuation rod is mounted in the central passageway of the locking plate and in the passageway of the second mounting plate. Owing to the central passageway of the locking plate and the passageway of the second mounting plate, the actuation rod is mounted at two points that are spaced apart from one another, which is accompanied with a precise positioning and alignment of the actuation rod. A bearing element, e.g., a sliding bearing, can be respectively fixed in the central passageway and/or the passageway of the second mounting plate.

The passageways of the two mounting plates advantageously engage with projections on the first mounting plate and are welded to the first mounting plate. The positive fit between the projections and the passageways defines a relative arrangement of the first mounting plate and the second mounting plate, which simplifies the installation of the two mounting plates. The projections that engage in the passageways also define suitable welding points.

The locking tube is advantageously welded to the first mounting plate and/or the second mounting plate. The welding causes an indirect fixation of the locking plate relative to the hollow body.

In some variations, the base plate has a passageway that is provided for the locking element, which is especially configured as an elongated hole and a T-shaped passageway. The T-shaped passageway reduces the mass of the base plate and thus the weight of the barrier device, making it easier to carry the barrier device. As an alternative, the T-shaped passageway or, in general, a passageway that serves for mass reduction can also be omitted to inhibit the ingress of dirt into the hollow body and especially a penetration of dirt up to the anchoring mechanism (or at least make this more difficult).

Another object of the present disclosure is also a barrier system for a base surface that has a barrier device according to the present disclosure and a bottom insert that can be fixed on the base surface and defines an engagement space for the locking element of the locking device with a crosspiece arranged in the engagement space and which engages behind the locking element when the barrier device is in an anchored state. The bottom insert corresponds to the barrier device and is the bottom-side counterpart of the barrier device. The bottom insert makes anchoring of the barrier device on the base surface possible. The locking element can be pivoted into the engagement space. The crosspiece of the bottom insert is the bottom-side counterpart to the locking element of the barrier device.

In one form, the bottom insert comprises a cover plate, which has a slot-shaped engagement opening for the locking element. The cover plate fits flush against a surface of the base surface in the intended state of the bottom insert and thus proceeds as a continuation of the surface of the base surface. Only the slot-shaped engagement opening interrupts the otherwise closed surface of the base surface, which reduces the risk of tripping caused by the bottom insert.

The bottom insert can also comprise two side plates that laterally delimit the engagement space and hold the crosspiece, which are arranged at a distance from each other and extend parallel to each other from the cover plate. A distance between the two side plates is selected in such a way that the locking element can be freely pivoted between the two side plates.

The bottom insert can also comprise a bottom element that defines the engagement space transversely to the side plates, which is arranged between the side plates opposite to the engagement opening. The bottom element closes off the engagement space opposite to the engagement opening so that the bottom element makes available an overall pocket-shaped engagement space.

In one form, projections of the bottom element engage with passageways of the side plates and are welded to the side plates. The projections and passageways define a relative arrangement of the side plates and the bottom element so that installation of the bottom insert is facilitated. The projections that engage in the passageways also define suitable welding points.

A significant advantage of the barrier device according to the present disclosure consists in that it is easy to handle and allows a reliable temporary or permanent blocking off of a section of a base surface. As a result, it can be an important means of occupational safety and contribute to the safety of persons who, in one form, are moving together on a base surface such as the floor of a warehouse with autonomously driving industrial trucks.

Further areas of applicability will become apparent from the description provided herein. It should be understood that the description and specific examples are intended for purposes of illustration only and are not intended to limit the scope of the present disclosure.

DRAWINGS

Other features and advantages of the present disclosure will be described in more detail with the aid of various variations and with reference to the enclosed drawings. The following:

Figure 1:
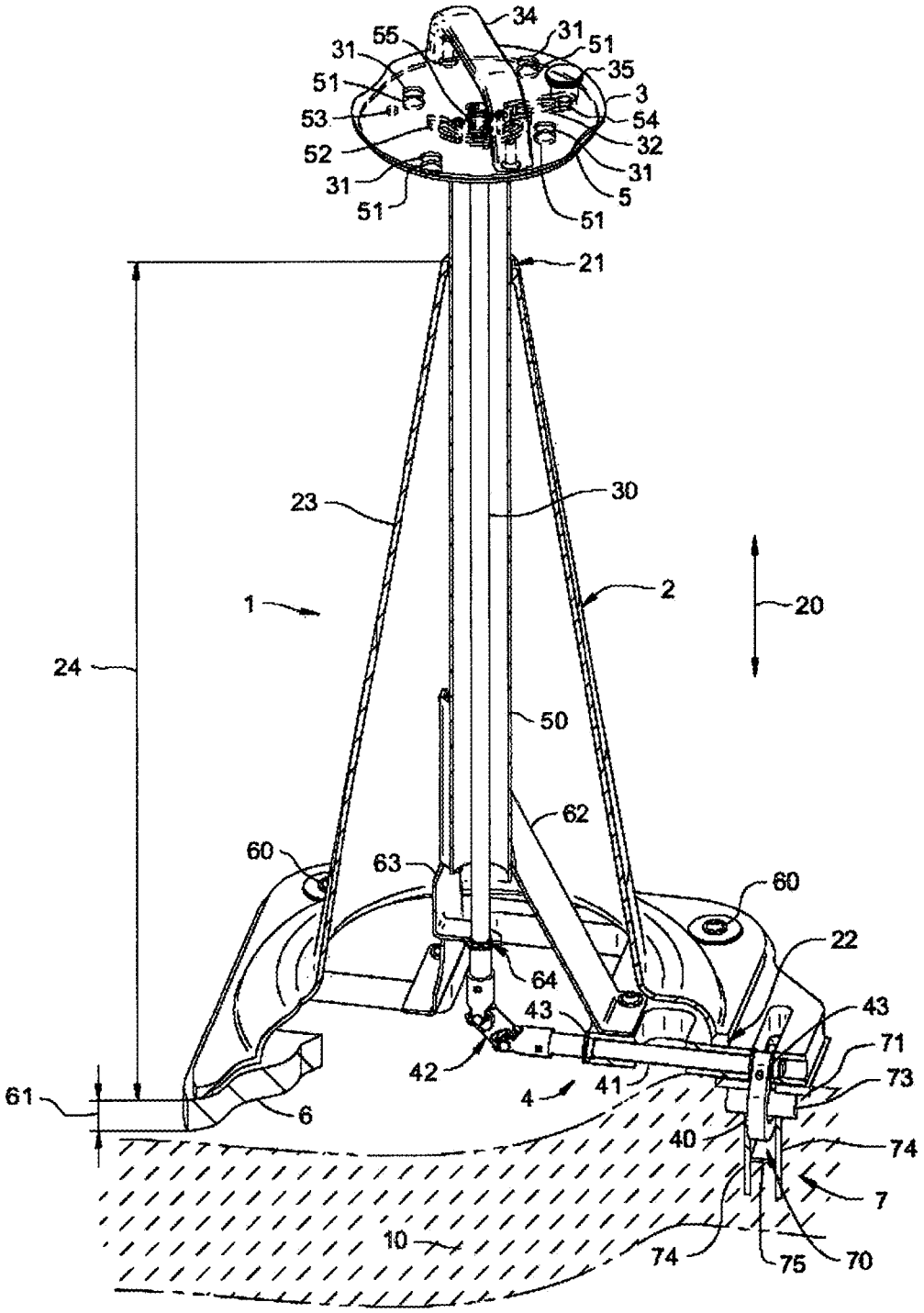
FIG. 1 shows a schematic representation of a partial section of a perspective lateral view of a barrier system according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a schematic representation of a partial section of a perspective lateral view of a barrier system according to a variation of the present disclosure. The barrier system comprises a barrier device 1.

The barrier device 1 is suitable and provided for arrangement on a base surface 10 and comprises an at least essentially tubular hollow body 2, which defines a longitudinal direction 20 of the barrier device 1. The barrier device 1 is configured as a traffic cone, and the hollow body 2 has a conical jacket-shaped peripheral wall 23. As an alternative, the barrier device can be configured as a barrier post, and the hollow body can have a corresponding cylinder-shaped peripheral wall. As another alternative, a cross section contour of the hollow body perpendicular to the longitudinal direction 20 can also have a shape that differs from the circular shape, for example, an oval, ellipsoidal, or polygonal shape, in one form a triangular shape. A length 24 of the hollow body 2 measured in longitudinal direction 20 is 500 mm, but can also be 300 mm, 700 mm, or 900 mm in other forms, or can be within a range of 100 mm to 1100 mm.

The barrier device 1 further comprises an actuation element 3, which is arranged on a first free end 21 of the hollow body 2 and can be moved relative to the hollow body 2 between a release position and an anchoring position.

Figure 2:
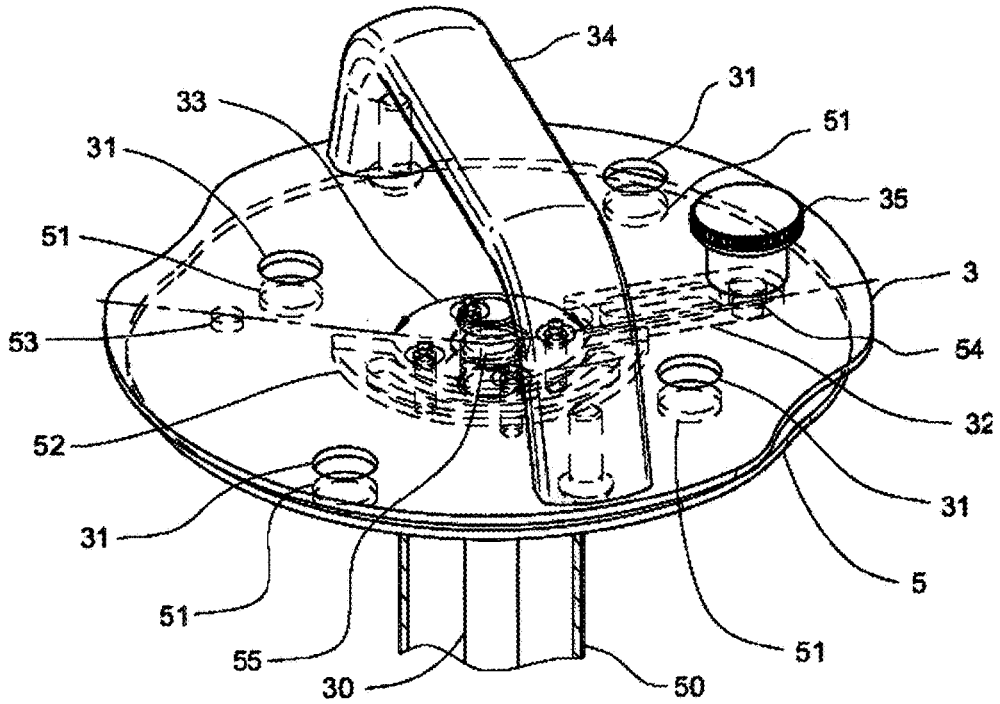
FIG. 2 shows a schematic representation of a perspective detail view of the actuation element of the barrier device of the barrier system shown in FIG. 1 in anchoring position, according to the teachings of the present disclosure.

FIG. 2 shows a schematic representation of a perspective detail view of the actuation element 3 of the barrier device 1 of the barrier system shown in FIG. 1 in the anchoring position.

Figure 3:
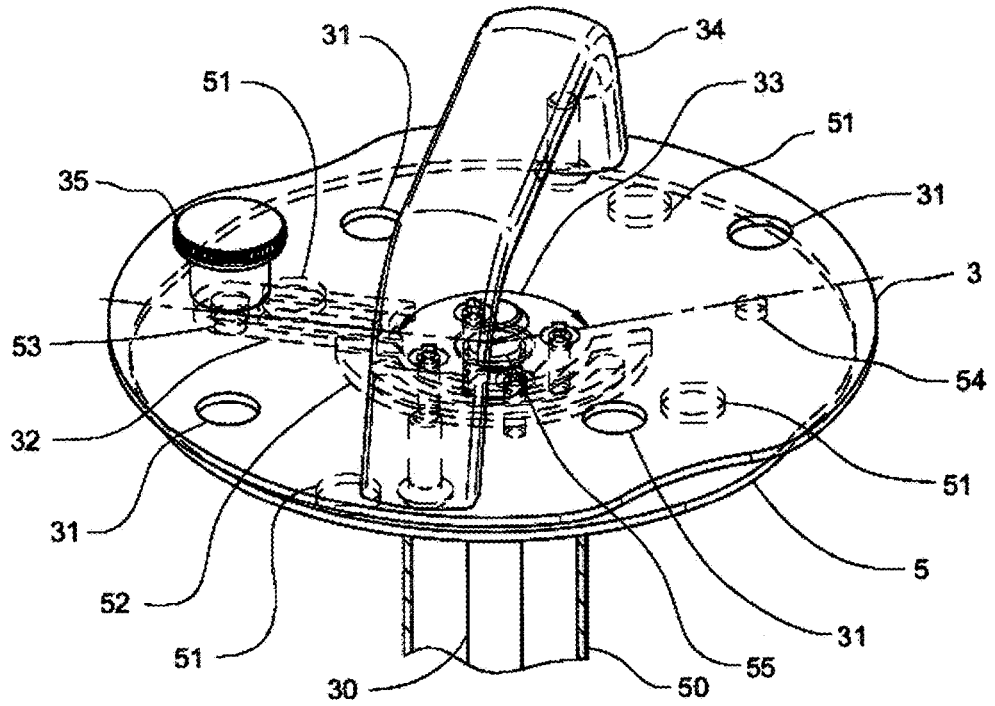
FIG. 3 shows a schematic representation of a perspective detail view of the actuation element of the barrier device of the barrier system shown in FIG. 1 in release position, according to the teachings of the present disclosure.

FIG. 3 shows a schematic representation of a perspective detail view of the actuation element 3 of the barrier device 1 of the barrier system shown in FIG. 1 in the release position.

The barrier device 1 comprises an actuation plate as the actuation element 3, e.g., the actuation element 3 is configured as an actuation plate. The actuation plate 3 has an at least essentially circular outer contour and extends perpendicular to the longitudinal direction 20. The barrier device 1 also includes a handle 34, which has an at least essentially U-shaped configuration, is fixed on the actuation plate 3 and projects from the actuation plate 3. The handle can, of course, have another shape; in one form, it can have an L-shape.

The actuation plate 3 has four holes 31. An actuation plate with exactly one hole 31 or one with a number of holes 31 that differs from four is also possible.

The barrier device 1 also comprises a locking plate 5, which is fixed relative to the tubular hollow body 2. The locking plate 5 extends perpendicular to the longitudinal direction 20. The actuation plate 3 extends parallel to the locking plate 5 in the release position, the anchoring position, and in every position between the release position and the anchoring position.

The locking plate 5 also has four holes 51 forming four hole pairs together with the holes 31 of the actuation plate 3. A locking plate with exactly one hole 51 or one with a plurality of holes 51 that differs from four is likewise possible. In any case, each hole 51 of the locking plate 5 forms a hole pair together with a respective hole 31 of the actuation plate 3.

Each hole 31 of the actuation plate 3 and each hole 51 of the locking plate 5 are boreholes and each of them have a cylindrical shape with a cylindrical axis that extends parallel to the longitudinal direction.

The locking plate 5 also has two recesses 53, 54 which are holes. In other variations, as the two recesses 53, 54 are depressions. The locking plate 5 also has a central passageway 55.

The actuation plate 3 comprises a locking bolt 35, which engages through the actuation plate 3, is mounted on the actuation plate 3 so that it can be displaced perpendicularly to the actuation plate 3 and pretensioned in the direction of the locking plate 5. The locking bolt 35 engages with a first recess 53 in the release position and with a second recess 54 in the anchoring position. When the locking bolt 35 is engaged, a movement of the actuation element 3 relative to the locking plate 5 is impossible. In other variations, a movement of the actuation element 3 relative to the locking plate 5 can be alternatively or additionally inhibit by means of mutually corresponding braking elements, e.g., by means of a frictionally locking connection between the actuation element 3 and the locking plate 5.

The actuation plate 3 can be rotated relative to the locking plate 5 around an actuation angle 33 of 150°, which is within a range of 120° and 180° in variations according to the present disclosure. The locking plate 5 and the actuation plate 3 comprise mutually corresponding stop mechanism 32, 52, which define the actuation angle 33 and the anchoring position and the release position and are arranged on the mutually facing main surfaces of the locking plate 5 and the actuation plate 3.

The holes 31, 51 are arranged in such a way with respect to each other that the four-hole pairs formed by the holes 31, 51 are aligned exclusively in the anchoring position, as can be seen in FIG. 2. In the loose position, however, the four-hole pairs formed by the hole pairs 31, 51 do not align, as can be seen in FIG. 3. The four hole pairs are arranged mutually spaced from one another in a radial direction related to an axis of rotation of a rotary movement of the actuation plate 3. In the anchoring position, the actuation plate 3 can be locked, in one form, by means of a padlock which engages through an aligned hole pair.

A mechanical anchoring mechanism 4, which is arranged opposite to the actuation element 3 with reference to the longitudinal direction 20 and comprises a movable locking element 40, is also part of the barrier device. The locking element 40 is a hook shape and is fixed on an anchoring shaft 41, and is in one form rotationally held on the anchoring shaft 41. The locking element 40 is arranged on an outer side of the hollow body 2.

The anchoring mechanism 4 also comprises a rotatably mounted anchoring shaft 41 and a coupling device 42. The coupling device 42 comprises a cardan joint with two universal joints. In another variation, the coupling device 42 is an angular gear with bevel gears. Two bearing elements 43 for bearing the anchoring shaft 41 are also part of the anchoring mechanism 4.

The barrier device 1 also comprises an actuation rod 30 that is fixed on the actuation element 3, which extends in the longitudinal direction, and is movably mounted, and which is arranged in the hollow body 2 and is mechanically coupled to the anchoring mechanism 4. The actuation rod 30 is an actuation shaft. The anchoring shaft 41 extends perpendicular to the actuation shaft 30. The coupling device 42 is adapted to transmitting a torque between the actuation shaft 30 and the anchoring shaft 41.

A locking tube 50, which extends in the longitudinal direction 20 and is fixed on the locking plate 5, is also part of the barrier device 1. The locking tube 50 is arranged in the hollow body 2, fixed relative to the hollow body 2, and partially projects from the hollow body 2.

The barrier device 1 also comprises a base plate 6.

Figure 4:
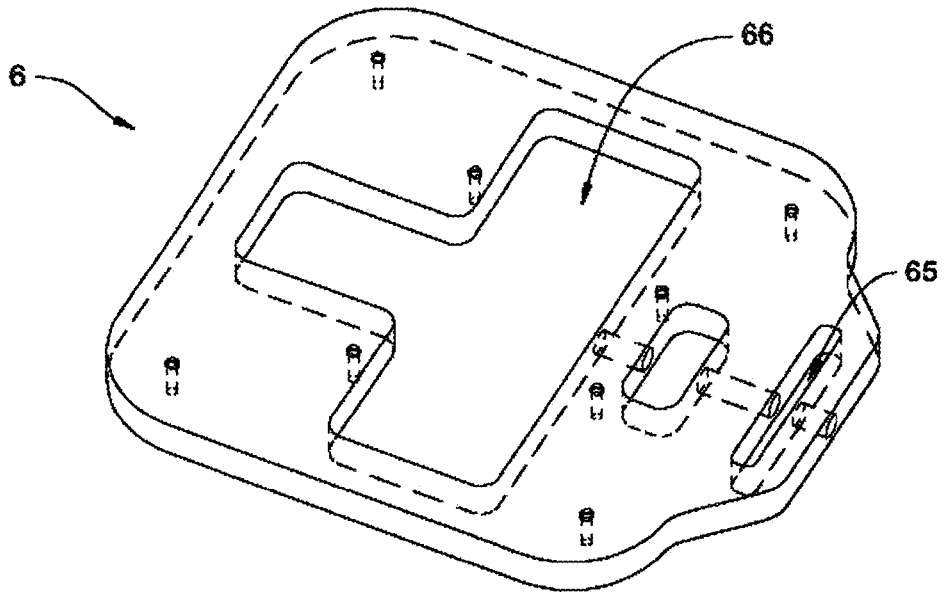
FIG. 4 shows a schematic representation of a perspective top view of the base plate of the barrier device of the barrier system shown in FIG. 1, according to the teachings of the present disclosure.

FIG. 4 shows a schematic representation of a perspective top view of the base plate 6 of the barrier device 1 of the barrier system shown in FIG. 1. The base plate 6 is arranged opposite to the locking plate 5 and attached at the second free end 22 of the hollow body 2, and detachably fixed by means of four screws. In other variations, it can be permanently fixed by means of rivets or an adhesive at the second free end 22 of the hollow body 2.

The base plate 6 is made of polyamide plastic. In other variations, the base plate can be made of a plastic other than polyamide or of metal or it can include polyamide or a plastic other than polyamide or metal. A thickness 61 of the base plate 6 measured perpendicular to the main surfaces of the base plate 6 or the longitudinal direction 20 is 20 mm and can be within the range of 15 mm to 35 mm in variations according to the present disclosure.

The anchoring shaft 41 is rotatably mounted on the base plate 6 by means of the bearing elements 43.

The barrier device 1 also comprises a first mounting plate 62 for holding the locking plate 50, which is fixed on the base plate 6. The first mounting plate 62 is detachably connected to the base plate 6, or more specifically, screwed to the base plate 6.

The barrier device 1 further comprises a second mounting plate 63, which is fixed on the base plate, for holding the locking tube 50. The second mounting plate 63 is detachably connected to the base plate 6, more precisely screwed to the base plate 6.

The second holding plate 63 comprises a passageway 64 for mounting the actuation rod 30. The actuation rod 30 is mounted in the passageway 55 of the locking plate 5 by means of a bearing element fixed in the passageway 55 and in the passageway 64 of the second locking plate 63 by means of a bearing element fixed in the passageway 64. However, the two bearing elements do not have to be available as separate components.

Passageways of the second mounting plate 63 engage with projections of the first mounting plate 62 and are welded to the first mounting plate 62. The locking tube 50 is welded to the first mounting plate 62 and the second mounting plate 63 but can also welded only to the first mounting plate 62 or only to the second mounting plate 63.

The base plate 6 has a passageway 65 provided for the locking element 40. The passageway 65 is an elongated hole. The base plate 6 can also have a T-shaped passageway 66 or a passageway with another shape.

The barrier system also comprises a bottom insert 7, which is fixed in the base surface, in one form by means of concrete.

Figure 5:
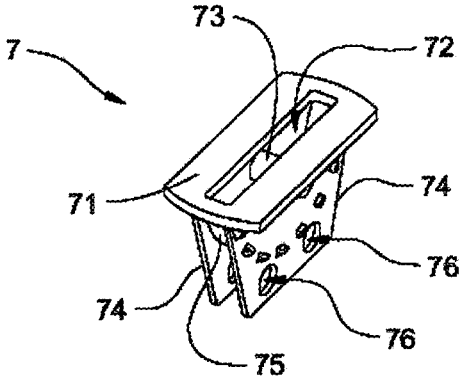
FIG. 5 shows a schematic representation of a perspective lateral view of the bottom insert of the barrier system shown in FIG. 1, according to the teachings of the present disclosure.

FIG. 5 shows a schematic representation of a perspective lateral view of the bottom insert 7 of the barrier system shown in FIG. 1. The bottom insert 7 can be fixed in the base surface 10 and defines an engagement space 70 for the locking element 40 of the barrier device 1. The bottom insert 7 comprises a crosspiece 73 arranged in the engagement space 70, which engages behind the locking element 40 in an anchored state of the barrier device 1.

A cover plate 71, which has a slot-shaped engagement opening 72 for the locking element, is part of the bottom insert 7. Two side plates 74, which lateral delimit the engagement space 71 and hold the crosspiece 73, are also part of the bottom insert 7. The side plates 74 are arranged at a distance from each other and extend parallel to each other from the cover plate 71. The side plates 74 each have two passageways 76, which are penetrated, in one form, by concrete in the intended state.

The bottom insert 7 also comprises a bottom element 75, which delimits the engagement space 70 transversely to the side plates 74 and is arranged between the side plates 74 opposite to the engagement opening 72. Projections of the bottom element 75 engage with passageways of the side plates 74 and are welded to the side plates 74.

In order to anchor the barrier device 1 to the base surface 10, the barrier device 1 is first provided with the actuation element 3 in the release position shown in FIG. 3. The provided barrier device 1 is then carried by the handle 34 to a bottom insert 7 which is fixed on the base surface 10 and arranged in such a way on the base surface 10 that the locking element 40 is arranged over the crosspiece 73 of the bottom insert 7. The locking bolt 35 is manually released from the locking plate 5 in a further step.

The actuation element 3 is subsequently manually applied with a torque. Because of the torque, the actuation element 3 is rotated by an actuation angle 33 into the anchoring position shown in FIG. 2. The torque that acts on the actuation element 3 is transmitted via the actuation rod 30 and the coupling device 42 to the anchoring shaft 41. The anchoring shaft 41 is consequently also rotated by the actuation angle 33 and the locking element 40 is pivoted in such a way that it engages behind the crosspiece 73 of the bottom insert 7.

If the actuation element 3 has reached the anchoring position, the locking bolt 35 locks with the locking plate 5 and aligns with the hole pairs formed by the holes 31, 51. By means of one or more padlocks, each of which engages through an aligned hole pair, the actuation element 3 can finally be securely locked in the anchoring position and the barrier device 1 can be anchored on the base surface 10 and can thereby be locked once or several times.

The previous steps are repeated in reverse order and in the opposite direction to release the barrier device 1. If the barrier device 1 is locked multiple times, of course all of the padlocks must be opened and removed from the engaged hole pairs before the actuation element 3 can be manually rotated into the release position.

Unless otherwise expressly indicated herein, all numerical values indicating mechanical/thermal properties, compositional percentages, dimensions and/or tolerances, or other characteristics should be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A barrier device to be arranged on a base surface, comprising:

an at least essentially tubular hollow body that defines a longitudinal direction of the barrier device;

an actuation element arranged on a first free end of the at least essentially tubular hollow body and adapted to move relative to the at least essentially tubular hollow body between a release position and an anchoring position;

a mechanical anchoring mechanism arranged opposite to the actuation element with reference to the longitudinal direction and comprises a movable locking element;

an actuator rod fixed on the actuation element that extends in longitudinal direction and is movably mounted, wherein the actuator rod is arranged in the hollow body and is mechanically coupled to the anchoring mechanism; and a locking plate fixed relative to the at least essentially tubular hollow body; wherein:

the actuation element comprises an actuation plate adapted to extend parallel to the locking plate in the release position, the anchoring position, and in each position between the release position and the anchoring position, each of the locking plate and the actuation plate respectively include at least one hole, wherein the at least one hole of the locking plate and the actuation plate together form at least one hole pair, and the at least one hole pair is aligned exclusively in the anchoring position, wherein in the anchoring position, the locking plate and the actuation plate extend perpendicular to the longitudinal direction.

2. The barrier device according to claim 1, further comprises a locking tube that extends in the longitudinal direction and is fixed on the locking plate, wherein the locking tube is arranged in the hollow body, is fixed relative to the hollow body, and partially protrudes from the hollow body.

3. The barrier device according to claim 1, wherein the hollow body includes a conical jacket-shaped peripheral wall or a cylindrical jacket-shaped peripheral wall.

4. The barrier device according to claim 1, wherein a length of the hollow body measured in the longitudinal direction is within a range of 100 mm to 1100 mm or includes one of 300 mm, 500 mm, 700 mm, or 700 mm.

5. The barrier device according to claim 1, wherein each of the locking plate and the actuation plate includes a plurality of holes, the plurality of holes correspondingly form a plurality of hole pairs.

6. The barrier device according to claim 1, wherein the locking plate and the actuation plate have an at least essentially circular outer contour.

7. The barrier device according to claim 1, wherein the actuation plate is adapted to rotate relative to the locking plate by an actuation angle, wherein the actuation angle is within a range of 120° and 180°.

8. The barrier device according to claim 1, wherein the locking plate and the actuation plate comprise a mutually corresponding stop mechanism, wherein the stop mechanisms define the actuation angle and the anchoring position and the release position and are arranged on mutually facing main surfaces of the locking plate and the actuation plate.

9. The barrier device according to claim 1, further comprises a handle fixed on the actuation plate, protrudes from the actuation plate, has an at least essentially U-shaped configuration, or a combination thereof.

10. The barrier device according to claim 1, wherein the locking plate has two recesses and the actuation plate has a locking bolt adapted to engage the actuation plate, wherein the locking bolt is movably mounted on the actuation plate perpendicular to the actuation plate, and is prestressed in the direction of the locking plate, wherein in the direction of the locking plate, the locking bolt engages with a first recess in the release position and with a second recess in the anchoring position.

11. The barrier device according to claim 1, wherein the actuation rod is an actuation shaft, and the anchoring mechanism comprises a rotatably mounted anchoring shaft extending at an obtuse angle or perpendicular to the actuation shaft and a coupling device, wherein the coupling device is adapted to transmit a torque between the actuation shaft and the anchoring shaft.

12. The barrier device according to claim 11, wherein the coupling device comprises an angular gear or a universal joint.

13. The barrier device according to claim 11, further comprises a base plate that is arranged opposite to the locking plate and is fixed to a second free end of the hollow body in a detachable or non-detachable manner.

14. The barrier device according to claim 13, wherein the base plate is detachably fixed to the hollow body using a plurality of screws.

15. The barrier device according to claim 13, wherein the base plate comprises a material made of at least one of plastic or metal, a thickness of the base plate, measured perpendicularly to the main surfaces of the base plate, within a range of 15 mm to 35 mm, or a combination thereof.

16. The barrier device according to claim 13, wherein the anchoring shaft is rotatably mounted on the base plate.

17. The barrier device according to claim 11, wherein the locking element having a hook shape and is fixed on the anchoring shaft.

18. The barrier device according to claim 1, wherein the locking element is arranged on an outer side of the hollow body.

19. The barrier device according to claim 13, further comprises a first mounting plate detachably connected to the base plate for holding a locking tube.

20. The barrier device according to claim 19, further comprising a second mounting plate detachably connected to the base plate for holding a locking tube with a passageway of the second mounting plate for storing the actuation rod.

21. The barrier device according to claim 20, wherein the locking plate has a central passageway and the actuation rod is mounted in the central passageway of the locking plate and in the passageway of the second mounting plate.

22. The barrier device according to claim 20, wherein the passageway of the second mounting plate engage with projections of the first mounting plate and are welded to the first mounting plate.

23. The barrier device according to claim 19, wherein the locking tube is welded to one of the first mounting plate, to the second mounting plate, or a combination thereof.

24. The barrier device according to claim 1, wherein the base plate has a passageway that is provided for the locking element, wherein the base plate is an elongated hole and has a T-shaped passageway.

25. A barrier system for a substructure, comprising:

a barrier device according to claim 1; and a base insert fixed in the substructure and defines an engagement space for the locking element of the barrier device with a crosspiece arranged in the engagement space, wherein the base insert engages behind the locking element in an anchored state of the barrier device.

26. The barrier system according to claim 25, wherein the base insert comprises a cover plate, wherein the cover plate has a slot-shaped engagement opening for the locking element.

27. The barrier system according to claim 26, wherein the base insert has two side plates that laterally delimit the engagement space and hold the crosspiece, wherein the two side plates are arranged at a distance from each other and extend parallel to each other from the cover plate.

28. The barrier system according to claim 27, wherein the base insert comprises a bottom element that delimits the engagement space transversely to the side plates, wherein the bottom element is arranged between the side plates opposite to the engagement opening.

29. The barrier system according to claim 28, wherein projections of the bottom element engage with passageways of the side plates and are welded to the side plates.

* * * * *